United States Patent [19]

Krautter

[11] 4,100,648

[45] Jul. 18, 1978

[54] HINGE

[75] Inventor: Kurt Krautter, Alpirsbach, Germany

[73] Assignee: Hetal-Werke Franz Hettich KG, Germany

[21] Appl. No.: 703,306

[22] Filed: Jul. 7, 1976

[30] Foreign Application Priority Data

| | | | |
|---|---|---|---|
| Jul. 8, 1975 | [DE] | Fed. Rep. of Germany | 2530321 |
| Oct. 24, 1975 | [DE] | Fed. Rep. of Germany | 2547602 |
| Jan. 30, 1976 | [DE] | Fed. Rep. of Germany | 2603465 |

[51] Int. Cl.[2] ..... E05D 3/06

[52] U.S. Cl. ..... 16/163; 16/145

[58] Field of Search ..... 16/162, 163, 164, 167, 16/145, 142, 180

[56] References Cited

U.S. PATENT DOCUMENTS

| | | | |
|---|---|---|---|
| 2,295,638 | 9/1942 | Doman | 16/164 |
| 3,590,420 | 7/1971 | Salice | 16/164 |
| 3,744,086 | 7/1973 | Salice | 16/164 |
| 3,864,786 | 2/1975 | Salice | 16/163 |
| 3,940,828 | 3/1976 | Lautenschlaeger | 16/163 |
| 3,940,829 | 3/1976 | Grunert et al. | 16/163 |

FOREIGN PATENT DOCUMENTS

| | | | |
|---|---|---|---|
| 2,408,057 | 8/1975 | Fed. Rep. of Germany | 16/145 |
| 2,140,833 | 2/1973 | Fed. Rep. of Germany | 16/145 |

*Primary Examiner*—James Kee Chi

*Attorney, Agent, or Firm*—Watson, Cole, Grindle & Watson

[57] ABSTRACT

A hinge includes a first part which is attachable to a furniture body and a second part which is attachable to a door, the first and second parts being connected by inner and outer guide links which are so constructed and attached to allow for the door to be swung away from the body and rotated through an angle greater than 90°. The inner guide line may comprise a slightly inwardly curved steel band which is wrapped at its end around a first pair of hinge pins respectively attached to the first and second parts, and the outer guide link may comprise an approximately straight steel band which is wrapped at its end around a second pair of hinge pins respectively attached to the first and second parts, but further away from the furniture body than the inner guide link. The hinge pin for the outer guide link which is attached to the second part is constructed such that the outer guide link is eccentrically arranged relative to the axis of its pivot at the adjacent end thereof.

19 Claims, 20 Drawing Figures

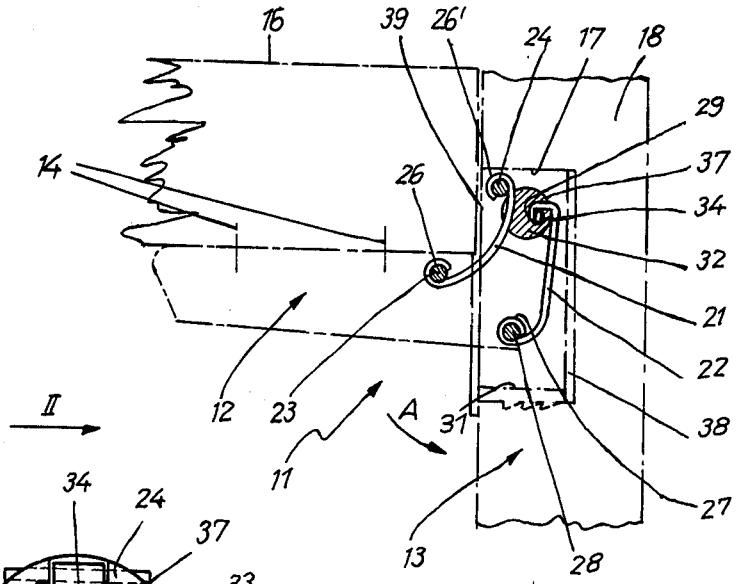
Fig. 1
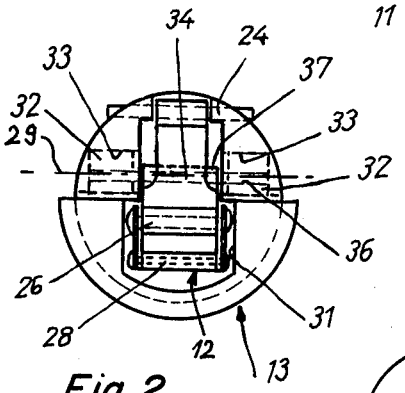
Fig. 2
Fig. 5a
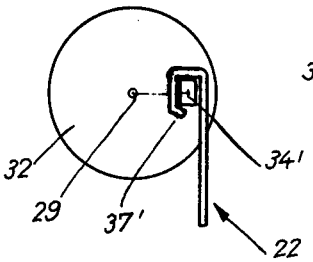
Fig. 5b
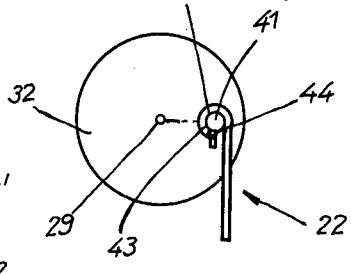
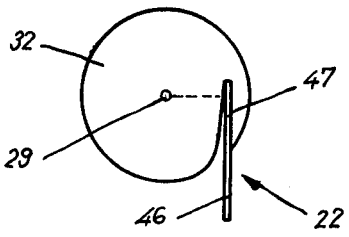
Fig. 5c
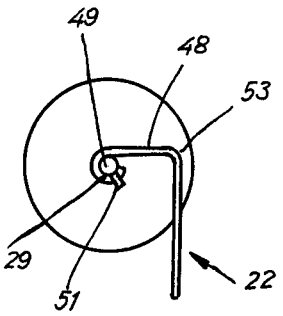
Fig. 5d

HINGE

BACKGROUND OF THE INVENTION

1. Field of the Invention

This invention relates to a hinge consisting of a first hinge part which may be fixed to a furniture body or the like, and a second hinge part which may be mounted on a door, or flap, or the like.

2. Description of the Prior Art

Conventional hinges of above-noted type are known wherein the two hinge parts are flexibly connected through an inner and an outer guide link, which are pivoted on hinge pins located on the respective hinge parts, and which constitutes an articulated, quadrilateral system which lifts the door, flap, or the like off the furniture body when it is opened, are designed as so-called "pot-hinges". In these hinges the pot-shaped part of the hinge is accommodated, as a rule in a recess in the door, flap or the like, and the corresponding articulated, movable, part of the hinge, consisting of a U-shaped metal section, which is screwed on to the furniture body using a mount. The guide links of these hinges are either straight or slightly curved, or they may be a multi-sided polygon connection, the link ends being rolled in to concentrically surround the associated hinge pins. The disadvantage of these known hinges is that their opening angle is limited to approximately 90° to 93°. However, it is in practice often desirable for a door, flap or the like to open through an angle wider than 90° or 93°, for example, when opening the doors of a radiogram, a kitchen corner unit or the like.

Admittedly, pot hinges have been known which have an opening angle of about 115°, but in these hinges the height or rather the pot depth has to be abnormally great in order to arrange the hinge pins at a sufficiently large spacing. This excessive height is, however, incompatible with the depth of the doors of the cupboard or the like. Other hinges are known which open through an angle wider than 90°, but these have a very complex linkage and incorporate additional elements which are slidable on the fixed parts of the hinge and are connected with the movable parts of the hinge in an articulated system. Not only is the design of these hinges complex, but their manufacture is cumbersome and they are correspondingly expensive. Hinges of this type therefore have a limited range of application: they are only built into furniture where it is indispensable for the doors to open through an angle wider than 90°.

It is an object of the present invention to provide a hinge of the aforesaid type which has an opening angle of more than 90° without exceeding the dimensions of a simple hinge and which, as a result of its moderate manufacturing costs, is still an article that can be made available as a mass-produced appliance.

SUMMARY OF THE INVENTION

According to the present invention there is provided a hinge comprising a first part adapted to be fastened to a furniture body or the like and a second part adapted to be fastened to a door, flap or the like, the parts being interconnected for relative movement by means of a pair of guide links which are mounted on pivots on the noted first and second parts of the hinge and which constitute an articulated arrangement for lifting the door, flap or the like off the furniture body or the like when the former is being opened, at least one of the guide links being eccentrically arranged relative to an axis of one end of its pivots, and the location at which the one guide link applies its force eccentrically on the one pivot being rotatable around the axis.

In this way the width of the opening angle may be increased to about 130° to 135° without using a pot-shaped hinge part of excessive dimensions. The hinge design according to the invention can still be simple and its manufacturing costs moderate because, again, not more than two guide links are used. This feature is important for the large scale manufacture of articles such as a hinge.

The eccentric articulation of the outer link may for example be provided on the first hinge part. However, it is often necessary for reasons of space restriction to apply the lever force eccentrically at a point on the second hinge part which, for example, may be pot shaped; this offers the space required with this form of articulation. Bearing in mind that the second hinge part is normally lifted into a recess in the cupboard door, it is clear that the eccentricity of the articulation remains unnoticed.

Preferably the one pivot comprises at least one bearing disc on which the end of the one guide link applies its force eccentrically. The one part may be defined by a drive pin which is embraced by the end of the one guide link, and which is non-rotatably connected with the or each bearing disc. Also, the drive pin may have at least one integral projection which rests against the embracing face of the end of the one guide link.

Preferably also the one pivot comprises a hinge pin rotatably mounted in the second hinge part and non-rotatably connected with the one guide link end by means of an eccentric arm.

Further the one pivot may comprise a hinge pin and the one guide link extend at approximately right angles to a radius of the hinge pin.

DESCRIPTION OF THE DRAWINGS

Embodiments of the present invention will now be described by way of example only with reference to the accompanying drawings, in which:

FIG. 1 is a section through a first embodiment of a hinge according to the invention, in a closed position;

FIG. 2 shows the hinge of FIG. 1 in its closed position as viewed in the direction of the arrow II in FIG. 1;

FIGS. 5*a* to 5*d* present variations of part of the linkage which is eccentric in relation to its hinge pin;

DESCRIPTION OF THE PREFERRED EMBODIMENT

Figure 3:
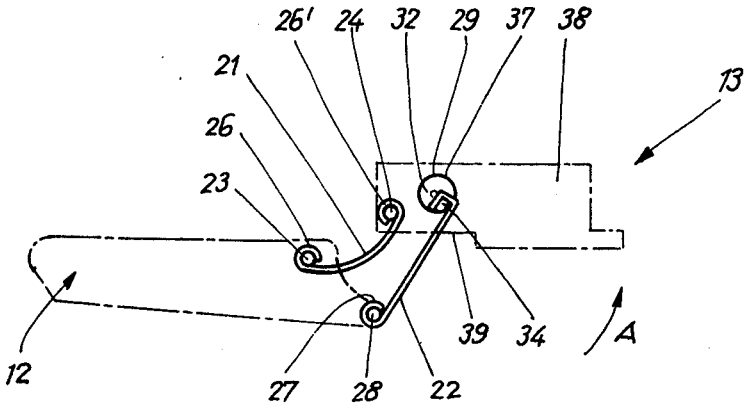
FIG. 3 shows the hinge according to FIG. 1, opened through 90°.

The hinge comprises a first part adapted to be fastened to a furniture body or the like and a second part adapted to be fastened to a door, flap or the like, the parts being interconnected for relative movement by means of a pair of guide links which are mounted on pivots on the first and second parts of the hinge, and together constitute an articulated arrangement for lifting the door, flap or the like off the furniture body or the like when the former is being opened. At least one of the guide links is eccentrically arranged relative to an axis of one of the pivots, and the location at which the one guide link applies its force eccentrically on the one pivot being rotatable around the axis.

The eccentric articulation of the outer link may, for example, be provided on the first hinge part. However, it is often necessary for reasons of space restriction to apply the lever force eccentrically at a point on the second hinge which, for example, may be pot shaped; this offers the space required with this form of articulation. Bearing in mind that the second hinge part is normally fitted into a recess in the cupboard door, it is clear that the eccentricity of the articulation remains unnoticed.

The eccentric articulation can be provided by a number of different designs. For example, the one pivot or hinge pin consists of two concentric bearing discs or the like, which are pivoted, at either side of the one guide link, in the second or movable part of the hinge, and non-rotatably support at least one drive element, say, a continuous drive shaft. This drive element is thereby surrounded by the end portion of the guide link, again in a non-rotatable manner. This non-rotatable connection may be conjugate or frictional, for example, the drive element and the corresponding opening in the bearing disc may have the same polygonal cross section. The drive element or pin may be surrounded in a similar manner by the one guide link. Alternatively, the pin may be press-fitted into the bearing disc, and its middle section may be provided with a projection which butts against the front face of the one guide link wich surrounds it. Seeing that the end sections are rolled in, this would seem to be a simple solution. The drive element(s), may however, also be an integral part of the bearing discs, or connected with the latter by welding, forging, or a similar method. Needless to say, any other form of conjugate or frictional contact would be feasible.

For example, the one hinge pin could be provided with only one concentric bearing disc located, for example, in the middle, and the end of the one guide link could act eccentrically through a drive pin or by being inserted in the movable part of the hinge or centrally at its two ends and fixed in a non-rotatable manner to the associated end of the one guide link, using an eccentric arm. The design is particularly simple when the eccentric arm and the one guide link are integral components because in this case all that is necessary is to bend the end portion of the one guide link in a suitable manner so that a lug is formed at its end, which constitutes the eccentric arm, and the edge of the bent portion provides the point of force application, that is to say, serves as the so-called drive shaft. This design, again, enables the eccentric pin to revolve around the one hinge pin with the one guide link, so that the zone of force application of the one guide link at the one hinge pin is similarly displaced when the door, flap or the like are opened.

The axis of the one guide link, which in the closed position was adjacent to one side of the pot-shaped part so that the one guide link may project beyond the edge of the pot shaped part which is adjacent to the first or fixed part of the hinge, and consequently enables the opening angle to be wider.

With all designs described above it is an advantage when the one guide link extends approximately at right angles to the radius of the hinge pin; that is to say when, as in the first embodiment, the one guide link extends approximately tangentially to the bearing disc and as in the last embodiment, the eccentric arm extends at right angles to the one guide link.

With another preferred embodiment, the guide links, referred to as the inner and outer guide links, are hinged to the other, preferably the fixed part of the hinge, in such a manner that with the hinge in its closed position the hinge pin of the inner guide link at the fixed part of the hinge is located on the other side of the transverse median plane of the outer guide link from the eccentric hinge pin of the outer guide link on the movable part of the hinge. With this arrangement the length — especially that of the inner guide link — may be somewhat increased to facilitate assembly. It is moreover possible to bend the two guide links in such a manner that the opening angle becomes wider than 130° to 135°. This solution can be assisted by cranking the portion of the fixed part of the hinge which is adjacent to the movable part of the hinge, because in this manner the door or the like lift off considerably more from the fixed part of the hinge, i.e., from the furniture body. The hinge pin of the outer guide link of the movable hinge part may consist of two bearing pins which face one another in alignment and support preferably parallel eccentric bars in an articulated system so that the inner guide link may be bent and hinged in such a manner that its corresponding end, with the hinge closed, extends approximately at the level of the hinge pin of the outer guide link at the movable part of the hinge, and preferably parallel to the plane of the outer guide link.

In certain conditions it may be an advantage to open the door, flap or the like generally by not more than 90° and to arrest it in this open position, and to increase the width of the opening angle to 140° to 155° as required. This can be done without using additional spring elements, by bending and shaping the inner and outer guide links in such a manner that the straight portion of the inner guide link rests against the hinge pin or the rolled end of the outer link of the fixed part of the hinge when opened to approximately 90°, and is then lifted off its support, overcoming the force of a pressure — or arresting point.

It may be intended to arrest the door, flap or the like both in the closed and in the opened positions in order to prevent it from being opened, or closed, unintentionally. With the type of hinge referred to in the introduction especially, i.e. with hinges designed as spring hinges which incorporate a spring blade as a resilient element it is favorable, simple in design and cheap in manufacture, when a rolled section on the inner guide link surrounding the hinge pin on the fixed part is provided with a stopping member against which one end of a spring element is supported. The latter extends over the two hinge pins on the fixed part and supports itself at its other end against the corresponding hinge pin, leaving a suitable spacing so that the spring retains the hinge in its opened or closed position whether the door, flap or the like is closed, or open, and the movements of closing or opening respectively have to overcome the dead-centre position of the spring element. In this manner the stationary time is high while the spring deflection is small, and the functioning is reliable, the door being safely held both in its opened and in its closed positions. When the spring elements are correspondingly designed, the spring mechanism may be controlled by a high spring tension. The spring element described above can moreover be used advantageously with conventional hinges which comprise guide links which surround the hinge pins concentrically.

The spring deflection is affected particularly favorably in systems where the spring cross section is the same in the closed and in the opened positions. When the spring end which acts against the outer guide link is fixed to the latter, the spring element will react to an angular displacement of both the outer and the inner guide links whereby both will be swivelled simultaneously. The spring position will either be altered by a rotation of the spring supporting member or it will remain unaffected, depending on whether the other spring end, which acts against the inner guide link is curved, say complementary to the circumference of an associated rolled section of the inner guide link, and supports itself against the spring supporting member, or is shaped like a hook, surrounding the rolled section, including the spring supporting member which projects in the radial direction, in such a manner that the spring supporting member rests against a different point on the inner wall of the hook shaped end portion whatever the position of the hinge.

Referring to the drawings, a hinge 11 according to the first embodiment is shown in FIGS. 1 to 4 and comprises a fixed part 12 and a movable part 13 hinged to the former. The fixed part 12 of the hinge is a U-shaped component bent of sheet metal which can be fixed to the furniture body 16 by means of screws 14 as indicated in the chain-dotted lines. The movable part 13 of the hinge is formed of a plastic material and is, for example, pot-shaped and is inserted into a cylindrical blind bore 17 in a door flap or the like 18 which is likewise indicated by chain-dotted lines so that it fits into the door, flap or the like in an axially fixed and non-rotatable manner. The hinging of the movable, pot-shaped part 13 on the door-side to the fixed U-shaped part 12 on the body-side is through two guide links 21 and 22 each of which comprises, for example, a steel band, the inner guide link 21 almost completely surrounding in a concentric manner a hinge pin 23 on the fixed part 12 of the hinge, and another hinge pin 24 which is located on the movable part 13 of the hinge, the end portions of the guide links 21 being rolled accordingly or provided with eyes 26 and 26'. The outer guide link 22, having a rolled end portion or eye 27 surrounds, again concentrically, a hinge pin 28 on the fixed part 12, but interacts, at its other free end, with a hinge pin 29 located in the movable part 13.

The hinge pins 23 and 28 extend between the side walls of the U-section constituting the fixed part 12 and are supported in them in such a manner that, as shown in FIG. 1, the hinge pin 23 lies outside the movable part 13 when the hinge is closed, the hinge pin 28 which is located in a narrow end section, engaging in a recess 31 in the movable part 13. Adjacent to the recess 31 there is provided a narrow section through which, as shown especially in FIG. 2, the hinge pins 24 and 29 extend, forming in a way a secant, whereby the pin 24 is located near the circumferential region. The four hinge pins 24, 23, 28, 29, are arranged in such a manner that they constitute with the guide links 21 and 22 through which they are connected, an articulated quadrangle capable of lifting the door, flap or the like off the furniture body during the opening process. The inner guide link 21 is thereby slightly curved inwards or deflected in such a manner corresponding to a multi-angled polygon, and the outer guide link 22 is approximately straight between its two end portions which are hinged to the pins.

With this preferred embodiment the hinge pin 29 is formed by two relatively spaced, parallel bearing discs 32, which are rotatable in bores 33 of the movable part 13 of the hinge. A drive pin 34 is supported on two bearing discs 32 so that it is non-retractable relative to the latter, the drive pin being eccentric relative to the hinge pin 29 which coincides with the centre of the bearing discs 32. In the embodiment shown in FIG. 1, the drive pin 34 is a continuous, square-section rod which is fitted into corresponding, eccentrically located, square openings 36 in the bearing discs 32 in a non-rotatable manner. The associated end of outer guide link 22 surrounds this square rod 34 with a correspondingly shaped eye 37 in positive contact so that it is non-rotatable through almost 360°. This eccentric force application of the outer guide link 22 at the hinge pin 29 and the rigid, that is to say, non-rotatable connection between the link 22 and the eccentric rod 34 make it possible to operate not only with an opening angle of 90° as shown in FIG. 3 but also with angles wider than 90°, the angle according to the embodiment represented in FIG. 4 being approximately 130° to 135° — without having to increase the depth of the normally used pot shaped part 13.

Figure 4:
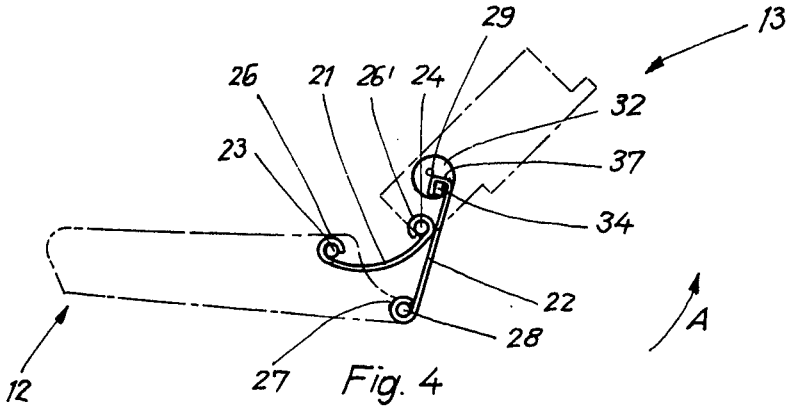
FIG. 4 shows the hinge of FIG. 1 in its fully opened position.

During the opening operation according to the arrow A, the eccentric rod 34 leaves its starting position near one side, i.e. the bottom 38 of the pot-shaped part 13 of the hinge, moving around the hinge pin 29 against the arrow A until it reaches a position where it is adjacent to the opposed or upper side 39 of the pot-shaped part 13 which means that it moves upwards in the recess 31. The eccentric rod 34, to which one end of the guide link 22 is fixed, enables the outer guide link 22 to move further beyond the edge of the movable hinge part 13 so that the opening angle is correspondingly increased. It has been found advantageous to allow the end of the outer guide link 22 which is provided with the square eye 37 to extend approximately tangentially to the bearing discs 32 so that the imaginary connection between the eccentric rod 34, the hinge pin 29 and the guide link 22 constitutes an angle of approximately 90°. The maximum opening angle of about 130° to 135° is limited by the contact made between the guide link 22 and the guide link 21 or rather its rolled portion or eye 26', as indicated in FIG. 4.

FIGS. 5*a* to 5*d* show schematically various eccentric and rigid possibilities of articulation of the outer link 22 at the hinge pin 29. The system according to FIG. 5*a* is similar to that shown in FIG. 1, the only difference being that the drive pin or rod 34' and the eye 37' each have a rectangular cross-section. The drive pin shown in FIG. 5*b* is a circular rod 41 which is pressed into a corresponding bore 42 in the bearing disc 32 in non-positive contact and in a non-rotatable manner. The guide link 22 has, at its corresponding end, a rolled section or a round eye 43 which surrounds the circular rod 41 concentrically but not completely. The circular rod 41 has at its circumference, at least in one region, a pin or projection 44 which can for example be an integral part of it, and butts against the front end face of the rolled section 43 so that it carries the guide link 22 along when rotating against the arrow 22. According to FIG. 5*c*, the lateral edges 46 of the middle section of the guide link 22 are inserted into slots 47 which are eccentric relative to the hinge pin 29 and located in the lateral bearing discs 32 or in a central bearing disc respectively, so as to constitute a conjugate, non-rotatable connection between the bearing discs 32 and the guide link 22. According to FIG. 5*d*, one end of the guide link 22 has an integral eccentric arm 48 the free end of which surrounds in conjugate contact a circular rod 49 with a projection 51, which serves as the hinge pin 29, the projection 51 extending through a slot in the eccentric arm 48. This eccentric arm 48, which is non-rotatably connected with the circular rod 49, may have the shape of a lug which extends at right angles towards the link 22, its length corresponding to the necessary eccentric displacement. The edge 53 of the angled eccentric arm 48 and guide link 22 thereby constitutes the eccentric shaft. It is self evident that alternative linkage systems could be used, the only conditions being that a non-rotatable connection must be provided between the outer link and the eccentric shaft and between the latter and the hinge pin.

Figure 6:
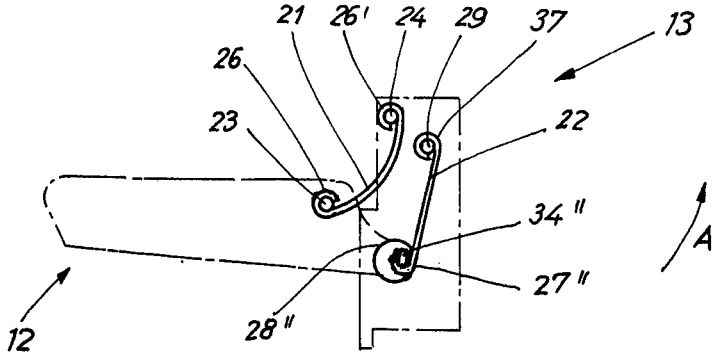
FIG. 6 is a second embodiment, similar to the first, but with eccentric articulation of the guide link on the first part of the hinge.
Figure 7:
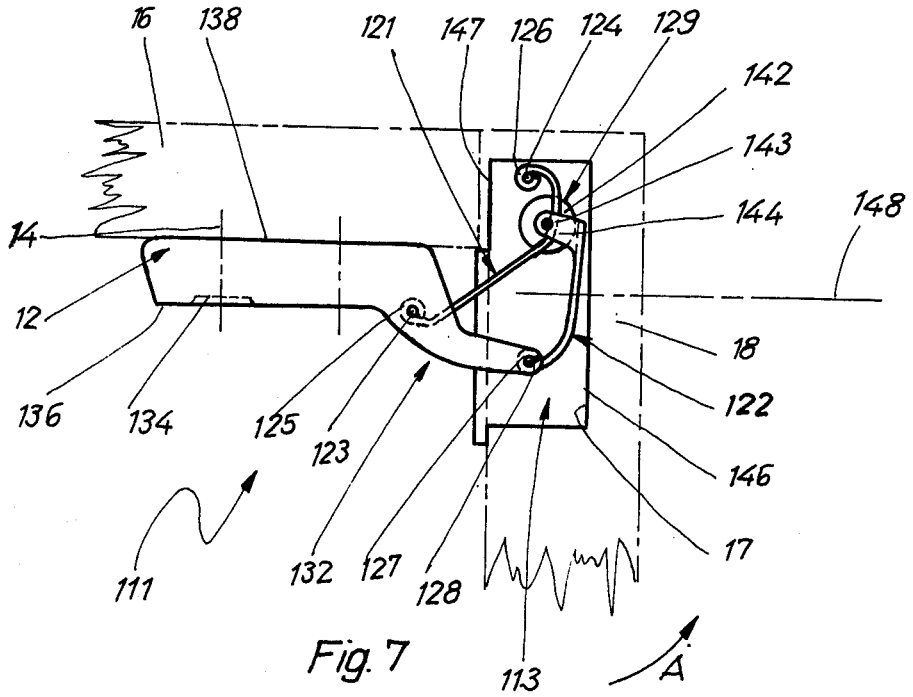
FIG. 7 is a section through a third embodiment of a hinge according to the invention, in a closed position.
Figure 8:
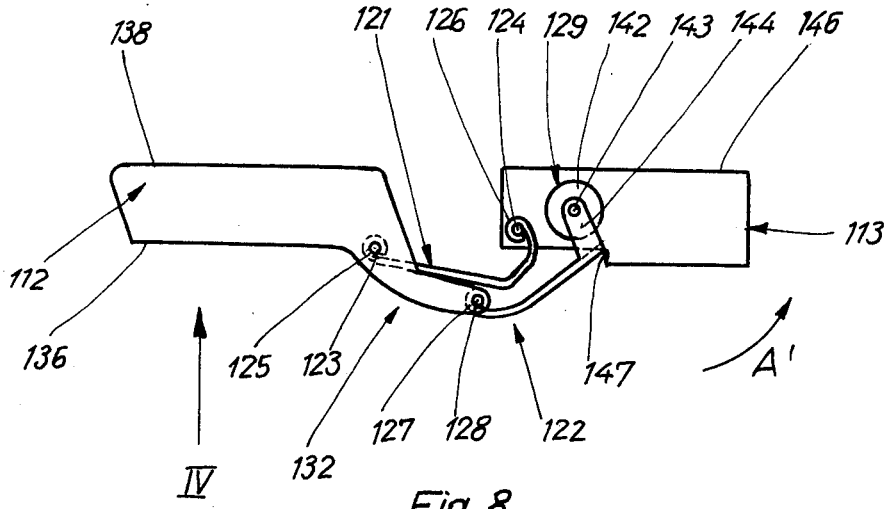
FIG. 8 shows the hinge according to FIG. 7, opened through 90°.

Another possibility is to hinge the link 22 to the fixed part 12 of the hinge, using the above principle. This is shown in FIG. 6 which relates to a second embodiment of the invention, and shown that the end portion 27'' surrounds a drive pin 34'' in conjugate contact, and applies its lever force eccentrically to the hinge pin 28'' of the fixed part 12 of the hinge, non-rotatably relative to the pin, while the hinge pin 29'' on the movable part 13 of the hinge is designed like the hinge pin 24 and surrounded by a rolled section 37''.

With the third embodiment shown in FIGS. 7 to 10, a hinge 111 consists, in analogy with the hinge 11 shown in FIGS. 1 to 4, of two parts 112, 113, two guide links 121, 122, and four hinge pins 123, 124, 128, 129, the latter serving as an eccentric shaft. The parallel hinge pins 123 and 128 extend perpendicularly to, and between, the side walls of an angled or rather a cranked section 132 of the U-section which constitutes the fixed part 112, the cranked region 132 being adjacent to the movable part 113. The section 132, cranked essentially by a dimension corresponding approximately to the depth of the pot shaped movable hinge part 113 begins substantially within that third of the length of an elongate fixing bore 133 which is adjacent to the movable part 113, and leads to another elongated fixing bore 134 which lies adjacent to the free end of the fixed hinge part 112 and comprises a recess. The hinge pin 123 of the inner guide link 121 is located in the zone where the cranked section 132 begins, aligning approximately with an edge 136 of a free or outer surface of the fixed hinge part 112 in which the fixing bores 133, 134 are provided. The part of the cranked section 132 adjacent to the movable part 113 is considerably narrower than the rest of the fixed hinge part 112; the hinge pin 128 of the outer link 122 is located immediately at the free end of the cranked section 132. The free or outer surface of the cranked section 132 comprises an elongate, unlatched recess 137 which opens towards the hinge pin 128, and extends at a small acute angle in a direction towards the inner engaging edges 138 of the inner walls of the U-shaped part 112, which are essentially parallel to the edge 136. The manner in which the guide links 121, 122 are hinged is such that in the closed position shown in FIG. 7, the hinge pin 128 in the cranked section 132 engages in the frontal region of a recess 141 in the movable pot-shaped part 113, its length corresponding almost to the diameter of the part 113.

In order to provide for an eccentrically acting hinge pin 129, two bearing discs 142 are fixed inside the pot-shaped part 113 in a non-rotatable manner or rather pressed into the pot-shaped cap, the diameter of these parallel discs being slightly smaller than the depth or thickness of the part 113 and the discs comprising integral short, concentric, bearing pins 143 align with and face one another. These bearing pins 143 engage with bores in the end portions of two parallel eccentric members 144 which extend along the edge of the narrower zone of the recess 141, the members 144 therefore being rotatable or rather swivellable around the bearing pins 143. The ends of the eccentric members 144 which are remote from the bearing pins 143 are fixed to the end of the outer guide link 122 which is remote from a rolled section 127.

With this embodiment the eccentric members 144 are designed in the form of lugs which extend perpendicularly from the end of the outer link 122 and its plane, being initially coplanar with the end of the link 122 before they are bent at right angles. Therefore the outer link 122 does not extend tangentially to the eccentric member 144 but includes with it an obtuse angle. With respect to their length, the eccentric members 144 correspond approximately to half the depth or thickness of the pot shaped part 113 so that they end, in the closed position, approximately at one side or the bottom 146 and in the fully opened position approximately just above the region 147 at the opposed side of the movable pot shaped part 113 which aligns with the inner surface of the door or the like, this being due to the fact that the bearing pins 143 are located substantially in a transverse median plane of the pot shaped hinge part 113.

The eccentric application of the lever force of the outer guide link 112 at the hinge pin 129 and its rigid, i.e., non-rotatable connection with the eccentric members 144, combined with the length of the members 144, are responsible for the fact that the hinge can be opened not only through 90° (FIG. 8) like a conventional hinge, and not only through an angle wider than 90°, namely 130° to 135° as the hinge discussed with the first and second embodiment, but through approximately 145° to 155° (FIG. 9), without increasing the thickness or rather the depth of the pot shaped movable hinge part 113.

Figure 9:
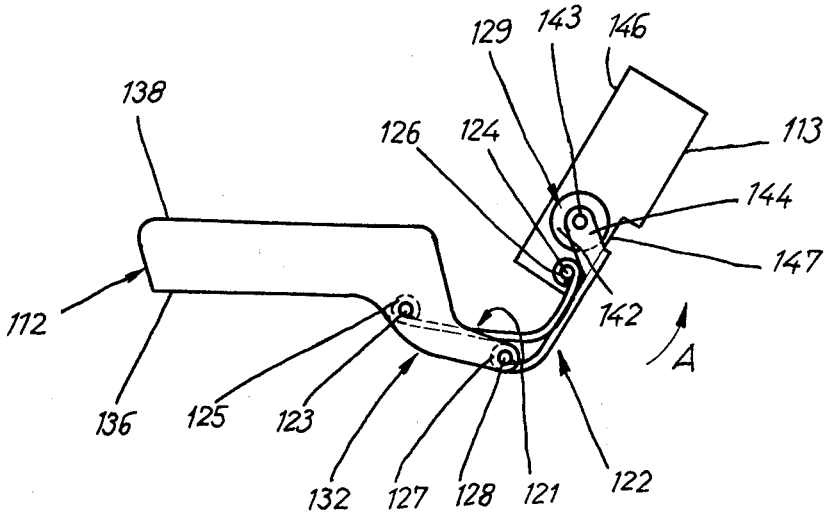
FIG. 9 shows the hinge according to FIG. 7, fully opened.
Figure 10:
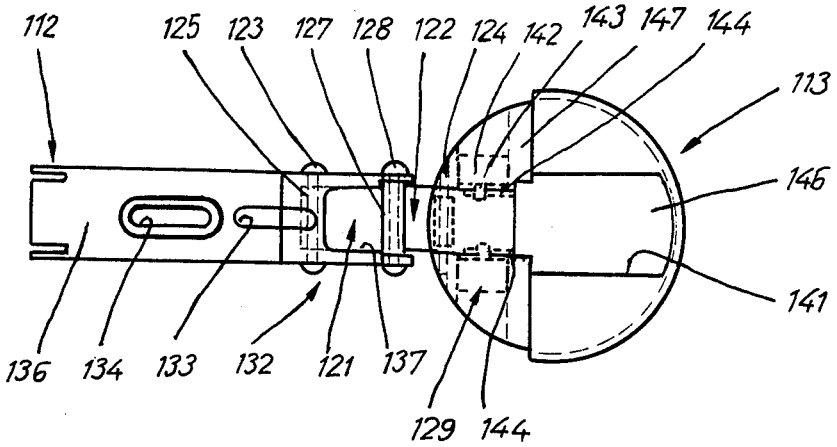
FIG. 10 shows a plan view of the hinge according to the third embodiment; as indicated by the arrow IV in FIG. 8.

As mentioned before, the outer guide link 122 moves when the hinge is opened in the sense of the arrow 'A', from a position parallel to and at the bottom of the pot shaped hinge part 113, in contact with the hinge part 113, around the hinge pin 129 to reach a position in which its end rests on the outer or upper side of the pot shaped part 113, covering the corresponding end of the inner guide link 121. This means that the end of the outer guide link 122 moves from the bottom to the upper end of the recess 141, or rather from the inside outwards, turning by approximately 180°. The eccentric members 144 make it possible — among other features, for the outer link 122 to project relatively far beyond the circumferential edge of the movable part 113 and this enables the turning angle to be wider than before. The outer link 22 is bent according to the lines of a preferably triangular polygon whereby one of its rolled ends extends inwards as shown in the plan according to FIG. 10. The inner guide link 121 has an approximately straight section which is adjacent to the fixed part 112 of the hinge, and adjacent to this a shorter section which faces the movable part 113, extends at an obtuse angle to the straight section, and is bent at least once more following the lines of a polygon. The two rolled ends of this link extend, again, inwards when viewed in a plan according to FIG. 10. The curved outline given thereby to the two guide links 121, 122, and the arrangement of the hinge pins 123 and 128 on the fixed part 12 of the hinge are combined in such a manner that in the closed position according to FIG. 7 the hinge pin 128 viewed from the position of the eccentric shaft arrangement of the guide link 121 is located at the other side of the transverse median plane 148 of the outer guide link 122. This can be attributed especially to the fact that the spacing between the two planes parallel to the contact edges 138 of the fixed part 112 at which the hinge pins 128, 128 are located, is very small, preferably equal to or twice the diameter of the corresponding rolled ends 125, 127. In addition to this, the form of the region of the inner guide link 121 which rests against the pot shaped hinge part 113 is such that in the closed state of the hinge 111 its shorter section which projects only a little beyond the bearing pins, extends between the bearing discs 142, at a level which aligns approximately with the pins or with the circumferential region of the bearing pins 143. Alternatively, the two links 121 and 122 can be given their special form and articulation by causing the longer section of the inner link 121 to touch, approximately in the hinge position with an opening angle of 90° (FIG. 8), the rolled section 127 of the outer link 122 which surrounds the hinge pin 128. This form of contact has, however, not the same effect as a stopping member but serves as a temporary arrest which is cancelled as soon as the force at a pressure point is overcome in order to cause the movable part 113 of the hinge to assume its fully opened position according to FIG. 9, where the opening angle is about 145° to 155°. To overcome the load at this pressure point, the guide links are band shaped because this permits especially the inner link to be elastically deformed. After overcoming the force at the point of arrest, the inner link is slightly separated from the rolled section 127. It is an advantage of this arresting mechanism, which does not require any additional means, that it prevents the fully opened hinge 111 from being unintentionally closed either completely or partly, and that it enables the hinge to retain its 90° angle if this is considered desirable for whatever reason. The end stop in the fully opened position according to FIG. 9 is provided by causing the outer link 122 to butt against the inner link 121 in an essentially two-dimensional contact extending over an area between the two hinge parts 112 and 113.

Figure 11:
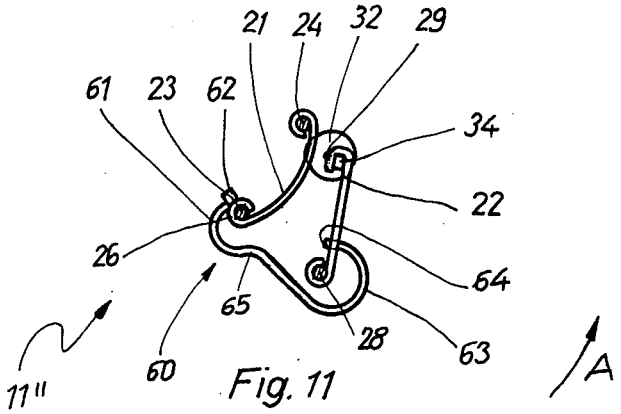
FIG. 11 is a section through a fourth embodiment of the hinge according to the invention, but the figure shows details only, namely the hinge pin, the guide links, and a spring element, all in schematic representation.
Figure 12:
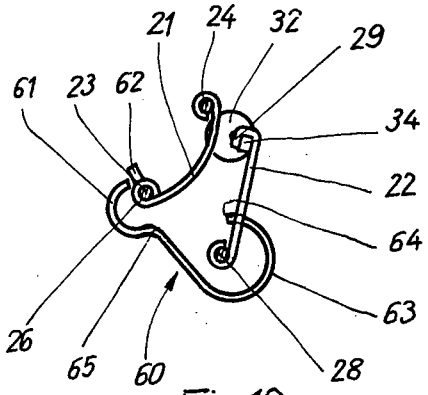
FIG. 12 shows the hinge according to FIG. 11 when opened through 90°.
Figure 13:
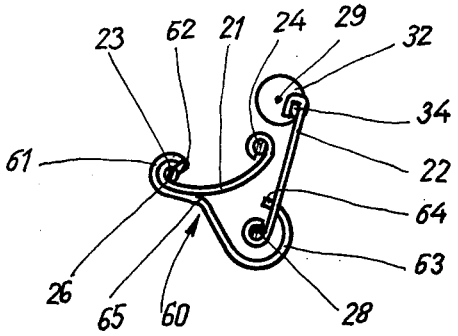
FIG. 13 shows the hinge according to FIG. 11 in its fully opened position.

The hinge 11″ which is presented in FIGS. 11 to 13 and relates to a fourth embodiment of the invention, corresponds essentially to the hinge 11, but comprises an additional spring 60, an end section 61 of which is hinged to an eye 26 of the inner guide link 121. The front of the end section 61 which thereby surrounds part of the eye 26 supports itself against a spring support 62 which may be a step, nose, hump or the like projecting in a radial direction from the eye 26, and which is connected with the latter in any suitable manner, conveniently constituting a stamped component. Moreover, the end section 61 of the spring 60 which supports itself against the spring stop 62, is bent to correspond approximately to the circumference of the eye 26 of the inner link 21. The spring 60 thus embraces the hinge pin 23 from the body side in a bow like manner and also encircles the other hinge pin 28 on the body side, which is surrounded by the spring 60 with play, the corresponding end portion 63 of the spring 60 being approximately semicircular and having a diameter which exceeds that of the associated hinge pin 28. This means that the end portion 63 does not rest against the hinge pin 28 or rather the respective eye 27 of the outer guide link 22; only its front face is supported at the outer link 22 a given distance away from the corresponding hinge pin 28, where it is fixed to the guide link 22. The end face of the end section 63 may comprise for this purpose a tongue shaped projection 64 which forms an integal part of the spring, and which engages with a correspondingly shaped recess in the outer link 22.

Figure 14:
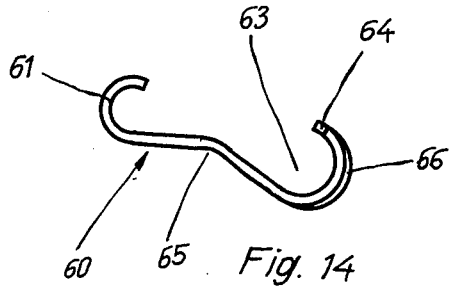
FIG. 14 shows a detail of spring element of the hinge presented in FIGS. 11 to 13.

As shown especially in FIG. 14, the spring 60 has a further indentation 65 between the two end sections 61 and 62 which again increases the spring effect, this indentation providing the spring 60 with an approximately 3-shaped cross-section.

A further means to increase the spring effect is a stiffening flange 66 provided in the end section 63 of the spring 60 which for reasons of simplification of the representations is shown only in FIG. 14.

The hinge shown in FIG. 11 is in its closed position, that is to say in the position in which the door seals the body 16 or rather its frontal side. When the door 18 and consequently the hinge part 13 on the door side are swivelled in the direction of the arrow A, the door 18 is immediately lifted off the front edge of the furniture body 16, as mentioned above. The spring 60 thereby applies a load on the guide link 22, which is directed against the arrow A. This means that during the opening of the door 18 a spring force has to be overcome which retains the door in its closed position. This spring force decreases in proportion to the increasing opening angle of the door 18 until the unstable dead centre position is reached where the spring 60 ceases to exert a torsional moment on the link. When the door is opened further than that, in the direction of the arrow A, the torque developed by the spring 60 is reversed so that the spring force assists the movement of opening in the direction of the arrow A until eventually the door is fully opened as shown in FIG. 13. In this position, in which part of the spring 60 is in contact with the inner guide link 21, the torque exerted by the spring 60 reaches its maximum value and the door is therefore safely arrested in its opened position. In any position, that is to say also in all intermediate positions, the spring 60 loaded by its own spring force, butts with its end 61 against the spring stop 62 which revolves together with the guide link 21 when the door is opened, as is clearly demonstrated in FIGS. 11 to 13. All in all, the spring deflection is very small, the spring 60 having the same cross section in the closed and in the opened position. When the door 18 is closed, the mechanism is in the opposite direction which means that first of all the force exerted by the spring has to be overcome until the dead centre position is reached, to enable the door 18 to automatically resume its closed position.

Figure 15:
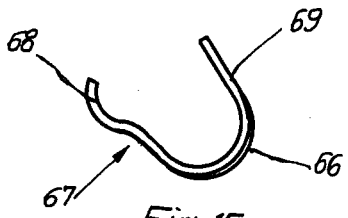
FIG. 15 shows a detail of different design of a spring element.

A spring 67 which is shaped differently is shown in FIG. 15. One end section 68 of this spring 67 is shorter, and the other end section 69 is longer, than the corresponding end portions 61 and 63, of the spring 60, and the end section 68 of the spring 67 describes approximately an arc of 90°. Again, this spring has a stiffening flange 66.

Figure 16:
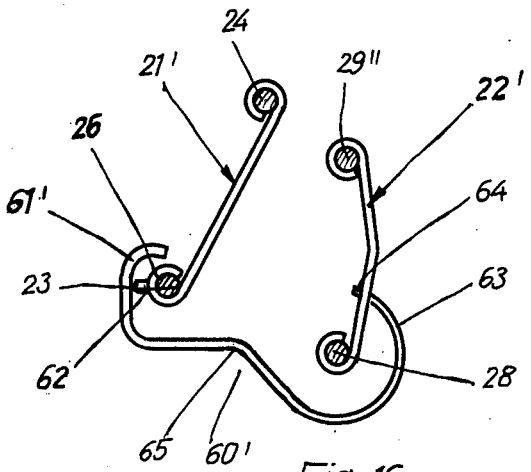
FIG. 16 shows a detail in a form similar to FIG. 11 but is related to a hinge according to the invention in its closed position, without eccentric articulation and again comprising a different spring element.
Figure 17:
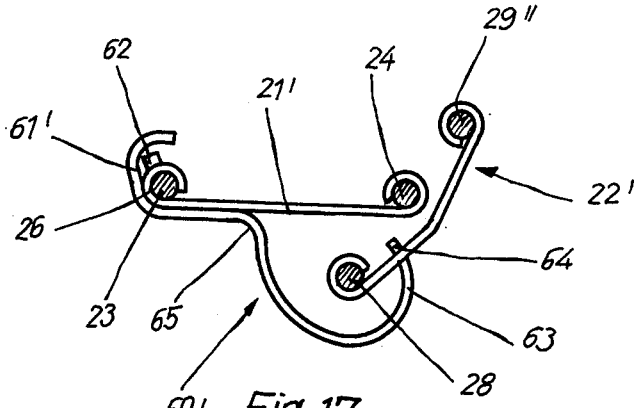
FIG. 17 shows the hinge according to FIG. 16 in the fully opened position.

The embodiment shown in FIGS. 16 and 17 differs from the other embodiments in so far as the spring design is different and all guide links 21', 22' are concentrically linked to all hinge pins 23, 24, 28 and 29''.

The example helps to demonstrate that a spring element can be an advantage even on a system using a normal i.e., concentric linkage. The fact that also the form of the guide links 21' and 22' is slightly different is irrelevant for the invention. To simplify the presentation, FIGS. 16 and 17 and also FIGS. 11 to 13, present merely the hinge pins, the guide links, and the spring. The hinge pins 23, 24, 28, 29'' and the guide links 21', 22' presented in FIG. 16 assume a position which corresponds to the position of the closed door as explained above in the light of FIGS. 1, 6, 7, and 11. The relevant difference is that the end portion 61' of the spring 60' is hook shaped, supports itself against the spring bearing 62 of the eye 26 of the inner guide link 21' and embraces the eye 26 of the inner link 21 including the spring bearing 62 which projects from it in the radial direction. The section of the hook like end section 61' is U-shaped, the spring bearing 62 resting against the transverse web of the U when the hinge is in its open position. When the door is swivelled into its opened position, that is to say when the two hinge links 21', 22' are moved from their positions according to FIG. 16 into their positions according to FIG. 17 the spring bearing 62 which revolves with the rest will slide along the inner wall surface of the hook shaped end section 61' so that the location of the spring is changed in accordance with the displacement of the spring support 62 resulting from the swivelling of the inner guide link 21. Again, this embodiment provides for a very short spring deflection. It is self evident that these deflection spring could also be used with the third embodiment according to FIGS. 7 to 10.

Various modifications can be made without departing from the invention.

Although my invention has been illustrated and described with reference to the preferred embodiments thereof, I wish to have it understood that it is in no way limited to the details of such embodiments, but is capable of numerous modifications within the scope of the appended claims.

Having thus fully disclosed my invention, what I claim is:

1. A hinge comprising a first part adapted to be fastened to a furniture body and a second part adapted to be fastened to a door, said parts being interconnected for relative movement by means of a pair of guide links which are each mounted on pivots on said respective first and second parts of the hinge so as to constitute an articulated arrangement for lifting the door off the furniture body when the former is being opened, at least one of said pair of guide links being eccentrically arranged relative to an axis of its pivot connected to said second part, and the location at which said one guide link applies its force eccentrically on said pivot being rotatable around the axis.

2. A hinge according to claim 1, wherein said pivot of said one guide link connected to said second part comprises at least one bearing disc on which the end of said one guide link applies its force eccentrically.

3. A hinge according to claim 2, wherein said pivot of said one guide link connected to said second part is defined by a drive pin which is embraced by the end of said one guide link, and which is non-rotatably connected to said at least one bearing disc.

4. A hinge according to claim 3, wherein the drive pin has at least one integral projection which rests against the embracing face of the end of said one guide link.

5. A hinge according to claim 1, wherein said pivot of said one guide link connected to said second part comprises a hinge pin rotatably mounted in said second hinge part and non-rotatably connected with said one guide link end by means of an eccentric arm.

6. A hinge according to claim 1, wherein said pivot of said one guide link connected to said second part comprises a hinge pin and said one guide link extends at approximately right angles to a radius of the hinge pin.

7. A hinge according to claim 1, wherein the eccentric location of force application is located to one side of said pivot in the vicinity of one side of said second hinge part when said first and second hinge parts are in closed position, and is movable into the vicinity of an opposed side of said second hinge part in the opposite direction relative to the movement of opening of the hinge, when said second hinge part is moved to its open position.

8. A hinge according to claim 1, wherein said pair of guide links are mounted on that one of the hinge parts which does not mount said one pivot in such a manner that the pivot of an inner one of the links is located, in the closed hinge position, at said one hinge part and in relation to said one pivot of the outer guide link on the other hinge part, on the other side of a transverse median plane of the outer guide link.

9. A hinge according to claim 8, wherein the pivots of the inner and outer guide links on said one hinge part are spaced apart in a direction perpendicular to the plane of the furniture body, by a distance approximately equal to the diameter or twice the diameter of rolled sections of the guide links which respectively embrace the pivots.

10. A hinge according to claim 9, wherein said first hinge part is said one hinge part, and that section of said first hinge part which is adjacent to said second hinge part, is cranked.

11. A hinge according to claim 10, wherein the pivot of the outer guide link on said first hinge part is located at the free end of the cranked section and the pivot of the inner guide link on said first hinge part is located at that zone where the cranked section begins, approximately in alignment with an outer edge of said first hinge part.

12. A hinge according claim 11, wherein the inner and the outer guide links are linked at said second hinge part in such a manner that, with the hinge in its closed position the respective end of the inner guide link is located approximately at the level of said one pivot of the outer link parallel to said transverse median plane, and parallel to the plane of the outer link.

13. A hinge according to claim 12, wherein said one pivot comprises two bearing pins which face one another in alignment and to which parallel eccentric members are linked, the ends of the latter remote from the linkage and constituting the location of force application, being rigidly connected with the outer guide link and defining therewith an obtuse angle.

14. A hinge according to claim 13, wherein the eccentric location of force application is, in the closed position of the hinge, parallel to, and located to one side of said second hinge part, and, in the fully opened position of the hinge, is aligned approximately with the outer surface of one opposed side of said second hinge part, or rests there against.

15. A hinge according to claim 14, wherein the outer and/or the inner guide links or link are or is bent in the manner of a polygon.

16. A hinge according to claim 15, wherein the inner and the outer guide links are bent in such a manner that a straight section of the inner link engages against a rolled section of the outer link which is located on the pivot for the latter on said first hinge part when the hinge is opened through 90°, and when the hinge is opened further, said straight section is moved out of said engagement.

17. A hinge according to claim 16, wherein one or both of the guide links is or are elastically deformable in respect of their bending.

18. A hinge according to claim 1, wherein said pair of guide links comprise an inner guide link positioned closely to a furniture body to which said first part of said hinge is adapted to be fastened and an outer guide link positioned closely to a door to which said second part of said hinge is adapted to be fastened, said one guide link comprising said outer guide link.

19. A hinge comprising a first part adapted to be fastened to a furniture body and a second part adapted to be fastened to a door, said parts being interconnected for relative movement by means of a pair of guide links which are each mounted on pivots on said respective first and second parts of the hinge so as to constitute an articulated arrangement for lifting the door off the furniture body when the former is being opened, at least one of said pair of guide links being eccentrically arranged relative to an axis of its pivot connected to said second part, and the location at which said one guide link applies its force eccentrically on said pivot being rotatable around the axis; wherein one guide link includes a rolled section which embraces one of the pivots on said first hinge part and has a spring bearing element thereon; said hinge including a spring bearing element which extends between both of the pivots on said first hinge part, one end of said spring bearing element being supported against said spring bearing element on said one guide link, the other end of said spring bearing element being supported against the second of said guide links so as to leave a clearance with the corresponding pivot on said first hinge part such that the spring element tends to retain the door in either its closed position or its open position with respect to the furniture body.

* * * * *